US005535235A

United States Patent [19]

Ao et al.

[11] Patent Number: 5,535,235

[45] Date of Patent: Jul. 9, 1996

[54] MELTING FURNACE HAVING PREHEATING VESSEL

[75] Inventors: Norio Ao; Hirotsugu Kubo, both of Kawasaki, Japan

[73] Assignee: NKK Corporation, Tokyo, Japan

[21] Appl. No.: 405,182

[22] Filed: Mar. 16, 1995

[30] Foreign Application Priority Data

Mar. 18, 1994 [JP] Japan ..... 6-049482

[51] Int. Cl.[6] ..... F27D 23/00

[52] U.S. Cl. ..... 373/78; 373/80; 373/84

[58] Field of Search ..... 373/78–81, 84

[56] References Cited

U.S. PATENT DOCUMENTS

| | | | |
|---|---|---|---|
| 1,034,788 | 8/1912 | Greene | 373/78 |
| 1,208,817 | 12/1916 | Moffat | 373/84 |
| 2,147,070 | 2/1939 | Weinheimer et al. | 373/78 |
| 2,236,329 | 3/1941 | Bryan | 373/78 |
| 3,439,909 | 4/1969 | Richards | 373/78 |
| 4,740,989 | 4/1988 | Steipe et al. | 373/78 |
| 5,416,792 | 5/1995 | Vice | 373/80 |
| 5,479,434 | 12/1995 | Burda | 373/78 |

FOREIGN PATENT DOCUMENTS

| | | |
|---|---|---|
| 4-309789 | 11/1992 | Japan . |
| 6-2095 | 1/1994 | Japan . |

*Primary Examiner*—Tu Hoang

*Attorney, Agent, or Firm*—Frishauf, Holtz, Goodman, Langer & Chick

[57] ABSTRACT

A melting furnace including preheating vessels for preheating raw material, and a melting furnace body having a tilting device and a heating device for heating the preheated raw material. A furnace roof covers an upper part of the melting furnace body and a combustion chamber for burning a gas generated in the melting furnace body is arranged on the furnace roof. Feed openings are arranged at side faces of the combustion chamber to feed the preheated raw material into the melting furnace body, and the side faces of the combustion chamber are positioned at a right angle to a tilting direction of the melting furnace body. Supply openings are arranged at lower ends of the preheating vessels to supply the preheated raw material through the feed openings to the melting furnace body. A connecting mechanism is provided for movably connecting the supply openings with the feed openings when the melting furnace body is tilted.

12 Claims, 5 Drawing Sheets

MELTING FURNACE HAVING PREHEATING VESSEL

BACKGROUND OF THE INVENTION

1. Field of the Invention

The present invention relates to a melting furnace having preheating vessels for preheating raw materials, and more particularly to an electric are furnace which heats and melts preheated metal which has been charged into the electric furnace.

2. Description of the Related Arts

A melting furnace is ordinarily equipped with a tilting device to discharge melted materials and floating slag. Japanese Unexamined Patent Publication No. 4-309789 discloses a melting furnace having a tilting device. As shown in FIG. 6, the melting furnace has toothed gears 2 and driving gears 3. The toothed gears 2 are circumferentially placed on both sides of a melting furnace 1. The toothed gears are supported and engaged with driving gears 3. When a melt is discharged, the melting furnace is tilted by rotating the driving gears 3.

The melting furnace is provided with a furnace roof 4 and preheating towers 5*a*, 5*b*. The furnace roof 4 covers a material opening 1*a* which is arranged at the upper part of the melting furnace 1. The preheating towers are cylindrically shaped. The preheating towers 5*a*, 5*b* stand on the furnace roof 4. Exhaust gas from the melting furnace rises up through the furnace roof to the preheating towers. There a plurality of preheating chambers 6*a*, 6*b* appropriate in number to be placed upwardly from the bottom part of the preheating towers. At an upper part of the preheating chambers, there is provided a discharge opening 7 to discharge the exhaust gas, the discharge opening being connected to an exhaust duct.

Further, below each of the preheating chambers, there is a damper 8 which freely opens and closes for holding raw materials. At an upper-most part of the preheating chambers, there is provided a retaining chamber for retaining raw materials supplied appropriately therein from outside of the system.

In the case of a steel-making electric arc furnace using a formed electrode, it is necessary to decrease consumption of the electrode. Japanese Unexamined Utility Model Publication No. 6-2095 discloses a measure for decreasing the consumption of the electrode. As shown in FIG. 7, scrap storing sections 11 at two locations on a furnace roof are prepared and an upper electrode 12 is inserted between the two scrap storing sections. Above the scrap storing sections, there are exhaust gas ducts 13 and scrap transporters 14 respectively.

In this disclosure, arc generated from the upper electrode is surounded by scraps 15, and radiation heat transfer efficiency to the scraps is high. Therefore, the length of the upper electrode can be shortened. For this reason, the consumption of the electrode can be suppressed to be small.

The mentioned melting furnace having the preheating towers for preheating the raw materials can attain the improvement in melting efficiency but has a disadvantage.

As shown in FIG. 6, the melting furnace 11 includes a furnace roof 4 on a material feed opening 1*a* of the melting furnace 1 which is of a type of a hollow circular cylinder being horizontally laid. To make the melting furnace itself tilted smoothly at the time of the discharge of a melt, it is necessary to make the furnace roof circular arc-shaped.

Thus, the preheating towers 5*a*, 5*b* placed standing on such high furnace roof occupies a highly tall level in space. Not only the structure of the preheating towers becomes highly tall but also a material trasporter transfering raw materials at such tall top of the preheating towers is required to be large-scaled and high-powered. Further, since a spacious gap between the melting furnace 1 and the furnace roof 4 is produced when the melt is discharged, gas containing dust or the like is scattered outside of the furnace and thus the work environment is worsened.

A portion, which is exposed within the melting furnace, of the electrode 10 inserted down to the melting furnace 1 from the top of the furnace roof 4 is longer in length than necessary. Therefore, the electrode 10 is exposed to a severely oxidized atmosphere and remarkably worn out due to oxidation.

The electric arc furnace of the Japanese Utility Model Publication No. 6-2095 is effective in suppressing the wear of the electrode, but has a problem here-below given.

In this electric arc furnace, there is no means for feeding supplied scraps into the electric arc furnace. The feeding of the scraps relies on natural drops of the scraps based on its dead weight. The operation has no problems so long as the scraps 16 are being smoothly fed from the two scrap storing sections into the electric arc furnace.

When, however, something wrong such as hanging within one of the scrap storing sections 11 happens, the feed of the scraps is one sided around the electrode 15. The melting of the scraps by the arc is thus non-uniform and the scraps are easily melted toward the electrode, which invites electrode damage.

Further, there is a difficulty in that the furnace roof 16 having the scrap storing section 11 has to be tilted integratedly together with the tilting of the electric arc furnace 17 when the melt is discharged. For this reason, the scrap storing sections 11 has to be emptied at the discharge of the melt. As the result of the emptying, it is impossible to preheat the scraps for the heat of the next melting.

In addition, due to lack of a combustion chamber, CO contained in exhast gas passing through the scrap storing section 11 fails to sufficiently be combusted into $CO_2$, and thus, the exhaust gas is of a low temperature and harmful.

SUMMARY OF THE INVENTION

It is an object of the present invention to provide a melting furnace having preheating vessels which enables to compact a furnace apparatus to be compact in size to burn an exhaust gas to make it high in temperature for use in preheating raw materials and to make it harmless to the environment, to feed the raw materials uniformly around an electrode, and further to reduce cost for reducing an oxidation loss of the electrode.

To achieve the object, the present invention provides a melting furnace comprising:

preheating vessels for preheating raw material to produce a preheated raw material;

a melting furnace body having tilting means for tilting the melting furnace body and heating means for heating the preheated raw material;

a furnace roof for covering an upper part of the melting furnace body;

a combustion chamber, arranged on the furnace roof, for burning a gas generated in the melting furnace body;

feed openings, arranged at side faces of the combustion chamber, for feeding the preheated raw material into the melting furnace body, said side faces of the combustion chamber being positioned at a right angle to a tilting direction of the melting furnace body;

supply openings, arranged at lower ends of the preheating vessels, for supplying the preheated raw material through the feed openings to the melting furnace body; and connecting means for movably connecting the supply openings with the feed openings when the melting furnace body is tilted by said tilting means.

DESCRIPTION OF THE EMBODIMENT

Figure 1:
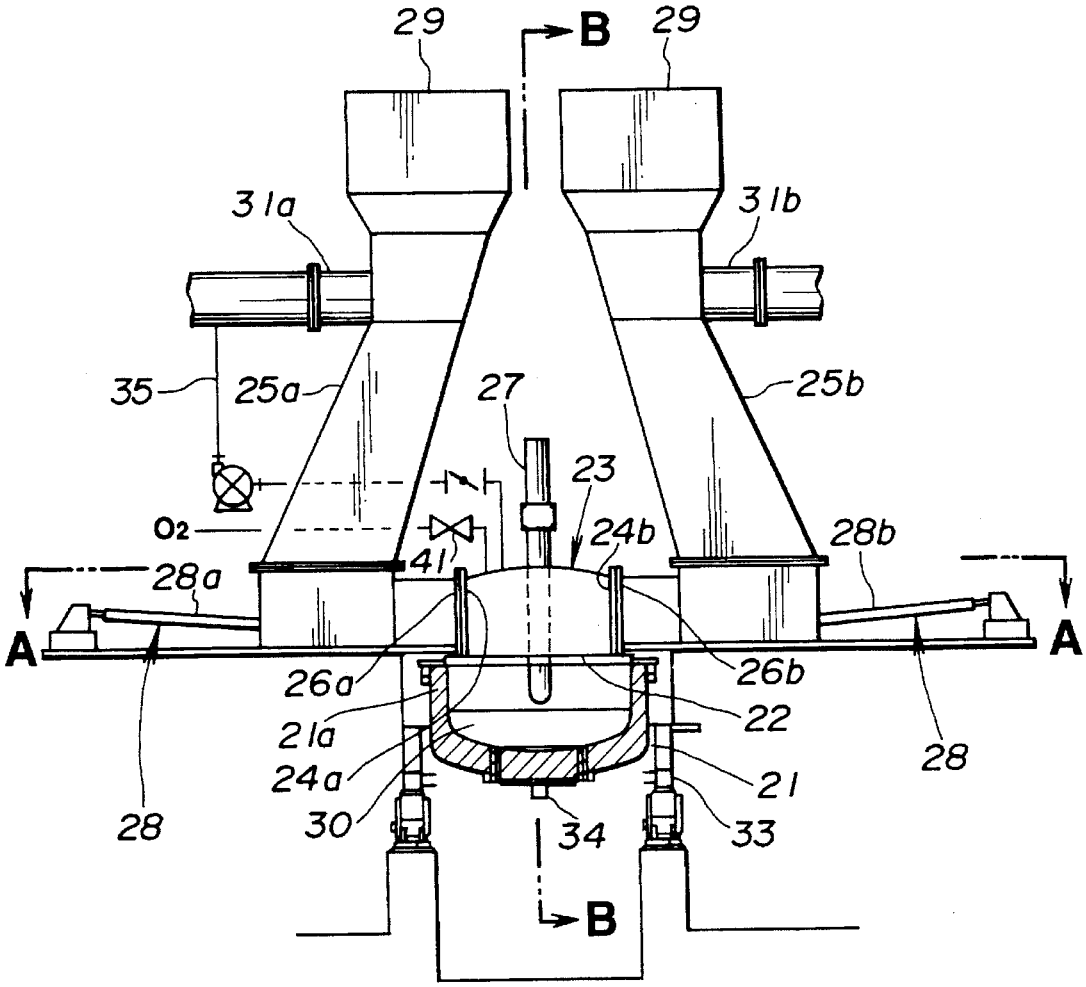
FIG. 1 is a partial cross sectional and broken front view of an example of the present invention.

The present invention provides a melting furnace having preheating vessels. The melting furnace includes preheating vessels for preheating raw material, a melting furnace body with tilting means, heating means for heating the preheated raw material which is fed to the melting furnace body and a combustion chamber for burning a gas generated in the melting furnace body. An upper part of the melting furnace body is covered with a furnace roof. A combustion chamber is placed on the furnace roof to burn a gas generated in the melting furnace body. The combustion chamber has feed openings at side faces which are positioned a right angle to a tilting direction. The preheating vessel has supply openings which are arranged at a lower ends thereof for supplying the preheated material through the feed openings to the melting furnace body. The feed openings are connected movably to the supply openings.

Since the combustion chamber is placed on the furnace roof, CO gas generated in the melting furnace burns, reacting with oxygen in the combustion chamber. For this reason the CO gas is fully burnt to be $CO_2$ gas and therefore the exhaust gas is elevated to be high in temperature and becomes harmless.

Thus, heat energy transfer to the raw materials in the preheating vessels is increased by the exhaust gas passing through the shaft-shaped preheating vessels via the combustion chamber, which enables the raw materials to be fed with a higher temperture. In addition, the exhaust gas is made harmless, which also reduces cost for treatment of the exhaust gas.

A joint portion has a mechanism in which the feed opening is movable in touch with the supply opening when the melting furnace is tilted for discharging the melt or removing slag. Due to the mechanism, the melting furnace can be tilted independently of the shaft-shaped preheating vessels.

The mechanism of the joint portion is constructed so that the feed opening and the supply opening can be in contact and that the former can be rotatable in touch with the latter or may be rotatable by having a slight spacious gap with the latter. Since the raw materials are fed to the melting furnace through two or more feed openings, a storing amount of raw materials per a shaft-shaped preheating vessel can be reduced to a half or less.

Furthermore, when in one of the preheating vessels something wrong with the feeding happens, in spite of stopping feeding of the raw materials in the problematic preheating vessel, the raw materials can be fed from another preheating vessel. Thus, the operation of the melting furnace can be continued.

A center of the feed opening and a center of the supply opening each accord with a tilting center axis of the melting furnace. So when the melting furnace is tilted, the feed opening and the supply opening are mutually in accord as the connecting means even if the melting furnace and the combustion chamber are integratedly tilted.

As a result, the discharge of high temperature exhaust gas and the feed of the raw materials can be performed during the tilting, dust collection efficiency and preheating efficiency can be improved, and further a sealing area of the connecting means can be minimized.

The melting furnace further includes removal means for removing the shaft-shaped preheating vessels, enabling the removal of the shaft-shaped preheating vessels far away from the melting furnace. When in one of the preheating vessels something wrong with material feeding happens, the problematic preheating vessel can be moved to a location far away from the combustion chamber by the removal means, and the problematic vessel can be separated from the melting furnace. As a result of this separetion, the troubling furnace can be inspected and repaired without stopping the operation of the melting furnace.

In the present invention, a movable electrode can be placed, as a heat source, outside of the combustion chamber. As a result, the movable electrode is not exposed to the exhaust gas having a high temperature within the combustion chamber and the are can be generated by inserting a movable electrode of short length. As a result of the shortening of the electrode length, the consumption loss of the electrode can be decreased.

EXAMPLE

Figure 2:
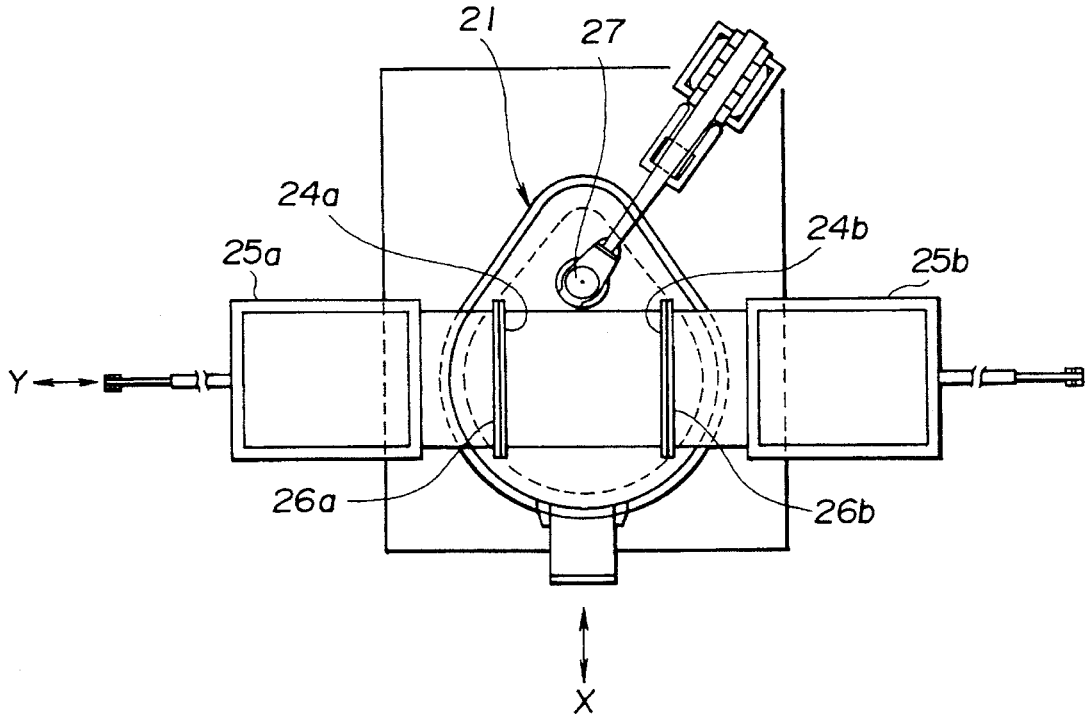
FIG. 2 is a view taken on line A—A of FIG. 1.
Figure 3:
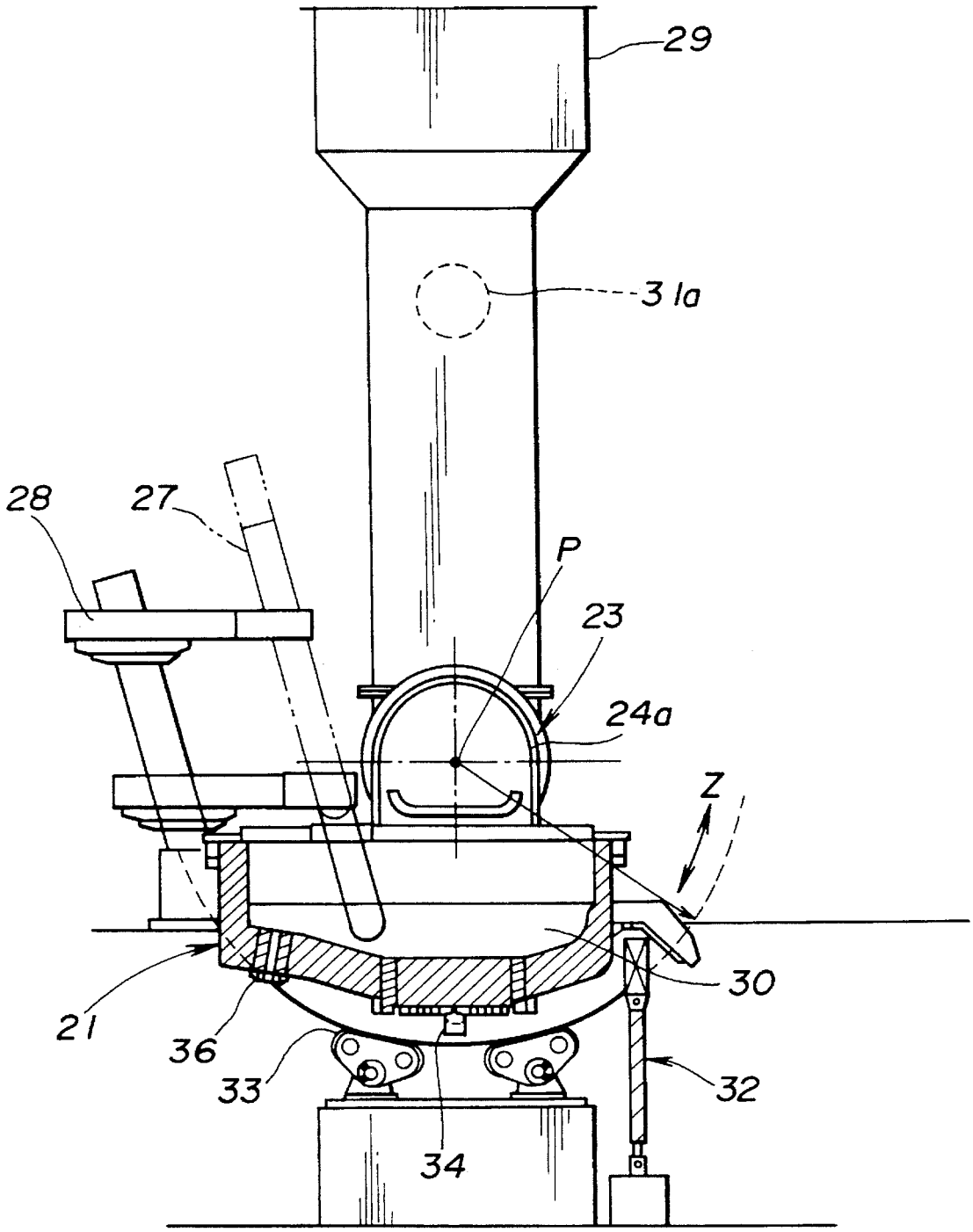
FIG. 3 is a view taken on line B—B of FIG. 1.

FIG. 1 is a partial cross sectional and broken front view of an embodiment of the present invention. FIG. 2 is a view taken on line A—A of FIG. 1. FIG. 3 is a view taken on line B—B of FIG. 1

Referring to FIG. 1, FIG. 2 and FIG. 3, reference numeral 21 denotes a melting furnace equipped with a tilting device and a furnace roof 22 placed on a melting furnace body 21*a*. Reference numeral 23 denotes a combustion chamber, placed on the furnace roof.

Further, material feed openings 24*a*, 24*b* are placed on both sides of the combustion chamber 23 in a direction perpendicular to a tilting direction of the melting furnace, and thus, preheated raw materials coming out of preheting vessels 25*a*, 25*b*, are fed uniformly in amount in a center portion of the melting furnace.

Reference numerals 25*a*, 25*b* denote shaft-shaped preheating vessels and the shaft-shaped preheating vessels have supply openings 26*a*, 26*b* connected to the feed openings 24*a*, 24*b* at a lower end part of the preheating vessels. Reference number 27 denotes a movable electrode which is inserted into the melting furnace body 21*a* from above the furnace roof 22 located near the combustion chamber 23.

With reference to FIG. 1, there is a charge opening 29 at a top portion of the preheating vessels, and raw materials are transferred from outside of the system by means of a conveyor system (not shown) and fed in the preheating vessels.

Feeding devices 28*a*, 28*b* are set at a lower portion of each of the preheating vessels 25*a*, 25*b*, and feed the supplied raw materials in a fixed, uniform quantity in a center portion of the melting furnace through the combustion chamber 23. In this embodiment, pushers are used as the feeding devices to alternately feed the raw materials. Thus, the raw materials are fed continuously little by little in quantity. Instead of the pushers, a mechanism such as a vibrating feeder can be used. A mechanism of a connecting means which is rotatable in touch is shown in FIG. 4.

Figure 4:
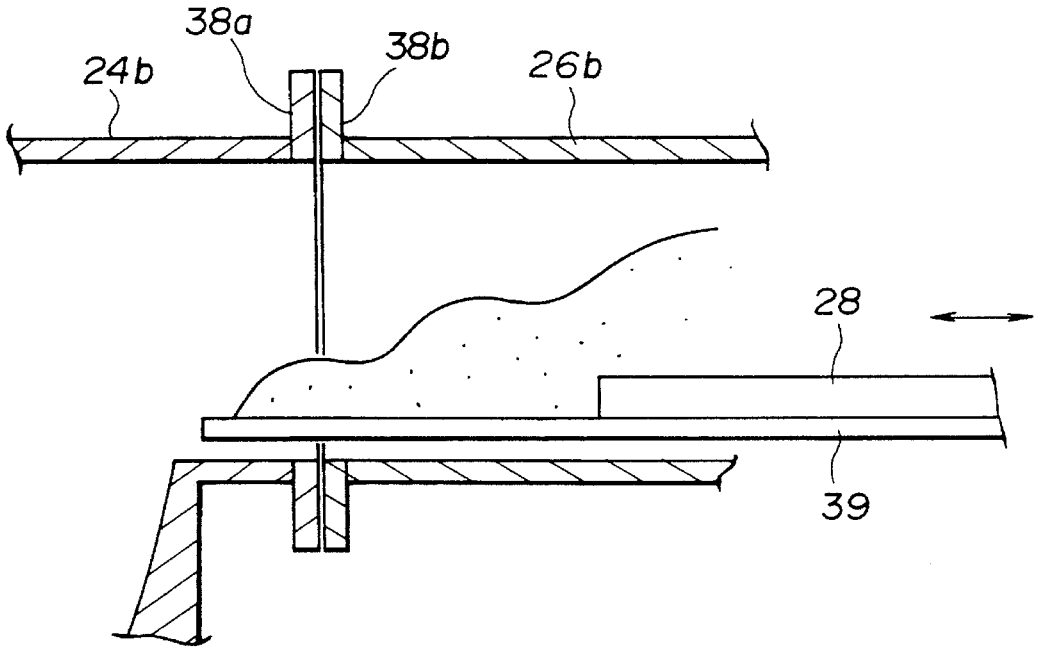
FIG. 4 shows of a joint portion mechanism comprising feed openings of a combustion chamber and supply openings of preheating vessels.

FIG. 4 shows an enlarged view of a major requirement part of an example of the present invention. The connecting means comprises a mechanism such that an end of the feed opening 24*b* and an end of the supply opening 26*b* each are fixed respectively to flanges 38*a*, 38*b*. By means of a simple pushing means (not shown), the feed opening and the supply opening are kept to be in touch with the flanges to the extent that the tilting movement is unfavourably affected.

Since a center of the feed opening 24*a* and a center of the supply opening 26*a* are respectively made to accord with a tilting center axis at the tilting movement, surfaces of the flanges 38*a*, 38*b* are rotatable in touch or rotatable with a slight spacious gap between the surfaces of the flanges. This combination of the flanges can be replaced by pipes different in diameter having a function similar to the foregoing. The raw materials are fed by the feeding device 28 into the melting furnace, using a feeder 39.

In the melting furnace 21 as shown in FIG. 1, arc is generated between the movable electrode 27 which is a heating source and the fed raw materials with are melted subsequently in turn. In response to a status level of change in melt 29, the movable electrode 27 is controlled to move up and down, thereby keeping the are stable.

Gas generated in the melting furnace 21 mixes with oxgen blown in through nozzles set in the combustion chamber 12, and burns. Even if the combustion chamber 23 is spaciously narrow in volume, the burning is sufficiently performed by cotrolling a blow-in amount of the oxygen through a control valve 41. In stead of oxygen, air can be blown in. The combustion chamber 23 can be equipped with a blow-in inlet 5. To protect the furnace roof 22 from being damaged due to an excessive reaction of the blown gas or the feed openings from being troubled in operation, a low temperature gas prevailing at a discharging side of the preheating vessels 25*a*, 25*b* is returned through the blow-in inlet. In stead of the low temperture gas, inert gas such as nitrogen produced in a factory can be used.

Exhaust gas after the combustion comes out of the cmbustion chamber 23 and passes through the raw materials filled in the preheating vessels 25*a*, 25*b*, preheats the raw materials and then, is discharged outside of the system through exhaust ducts 31*a*, 31*b* placed at an upper part of each of the preheating vessels 25*a*, 25*b*.

At this moment, by having the preheating vessels 25*a*, 25*b* lean toward a center axis of the melting furnace, the raw materials move toward the center axis of the melting furnace to fill up spacious gaps between the raw materials and a side wall of the preheating vessel. As a result, there is no room for the exhaust gas pass through among the spacious gaps. Thus, the raw materials can sufficiently be preheated.

As shown in FIG. 2, the material feed openings 24a, 24b are placed at both sides of the combustion chamber 23 arranged in a Y-arrow direction perpendicular to an X-arrow direction of tilting of the melting furnace 21. And the preheating vessels 25*a*, 25*b* have the supply openings 26*a*, 26*b* connecting the feed openings 24*a*, 24*b*.

Since the movable electrode 27 is placed outside of the combustion chamber 23, an electrode of short length can be used.

In this example, a single electrode 27 is used. However, a multiplicity of movable electrodes can be used as the case may require. Further, this example employs direct current, but alternate current can be used.

FIG. 3 shows an example of the present invention where the melting furnace 21 is tilted in a Z-arrow direction and discharges a melt 30 through a discharging hole 36.

In this example, since a center P of material feed opening 24*a*, 24*b* and a center of material supply opening 26*a*, 26*b* accord with a tilting center axis of the melting furnace 21 as shown by arrow, at the time of the tilting of the melting furnace 21, the feed opening 24*a* and the supply opening 26*a*, as connecting means, accord even if the combustion chamber is tilted integratedly with the melting furnace.

The melting furnace 21 is placed on a roll 34 so as to smoothly be tilted rotatably. When a direct current electric arc furnace is used, it is generally necessary for maintenace of continuous electric current flow that the movable electrode 27 is equipped with a bottom electrode 33 so that the melt stays above the bottom electrode at an initial melting stage. For this necessity, in the present invention, when the movable electrode 27 is tilted and moves down, the movable electrode 27 reaches the melt staying above the bottom electrode.

Figure 5:
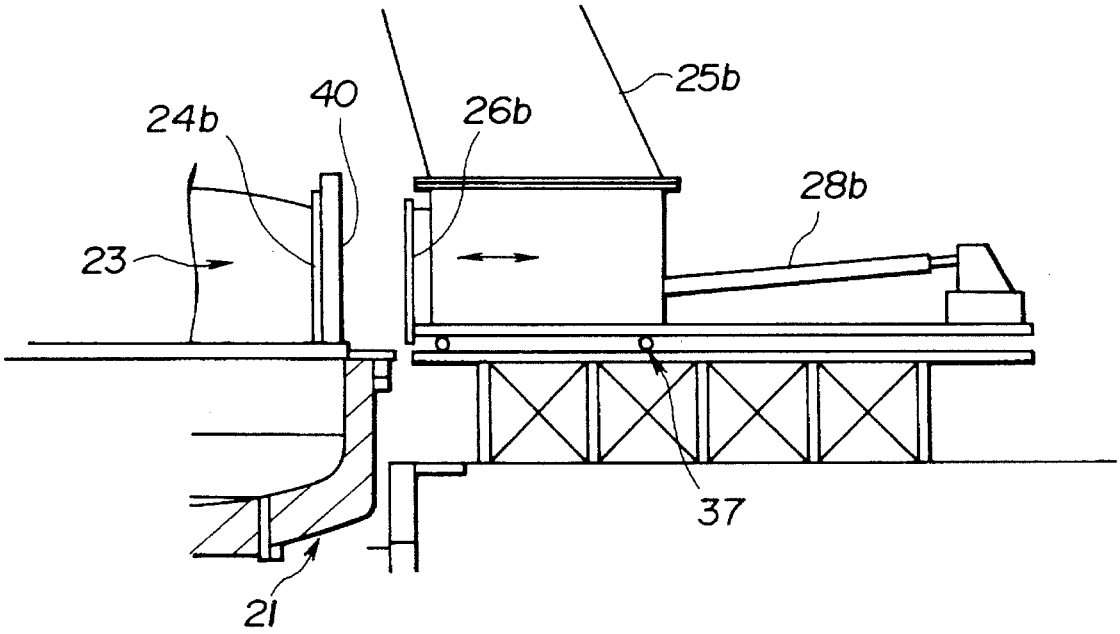
FIG. 5 shows a a separation plate according to of another example of the present invention.
Figure 6:
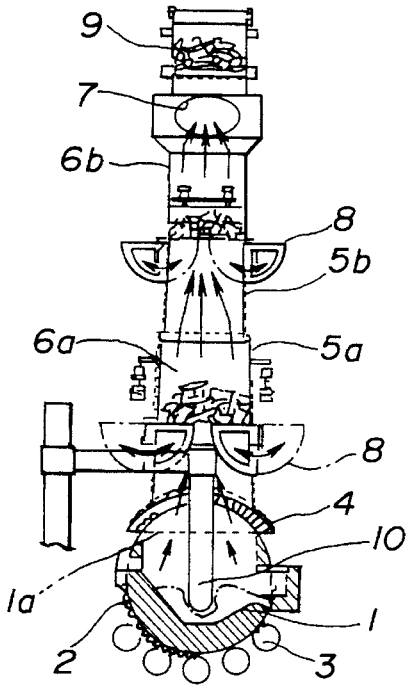
FIG.6 PRIOR ART
FIG. 6 shows a prior art melting furnace having preheating vessels.
Figure 7:
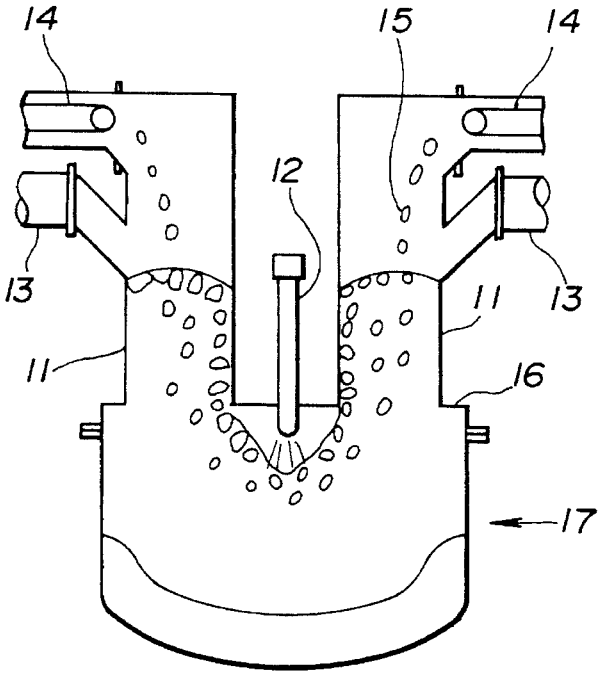
FIG.7 PRIOR ART
FIG. 7 shows a prior art electric arc furnace for feeding scrap continuously.

FIG. 5 shows a major requirement part of another example of the present invention. As shown in FIG. 5, the shaft-shaped preheating vessel 25*a* is mounted on a removing mechanism 37. When something wrong happens on a side of the preheating vessel 25*b*, a separation plate 40 is inserted in a joint portion to move the preheating vessel 25*b*, by a common driving device (not shown), to a location far away from the combustion chamber 23. Thanks to the insertion of the separation plate, the exhaust gas can be prevented from being discharged and a one-side preheating vessel operation can be performed without stopping the operation of the melting furnace.

According to the foregoing description, the present invention achieves the following effects:

(1) Since two or more of the preheating vessels are placed above both sides on the melting furnace, a storing amount of raw materials per one vessel can be reduced to a half or less, and the height of the preheating vessels can be reduced to a half or less. In addition, since the preheating vessels are not located right above the melting furnace, there is no possibility that the melting furnace collides with those preheating vessels at the time of the tilting movement of the melting furnace.

(2) Since the raw material is fed from a low location in height, there is only a little scattering of the melt occuring owing to the collision of the raw material each other and there is no trouble such as adhesion of the melt to the furnace roof.

(3) Since it is improved that the raw material fed in the melting furnace is one-sided in the furnace, consumption of bottom refractory and the bottom electrode is reduced. Therefore, improvement in refractory consumption unit and maintenance of the apparatus are eased.

(4) When some trouble happens with one of the preheating vessels, the melting furnace can continue to operate by separating the problematic preheating vessel from the smelting furnace. Thanks to this separation, non-operation time is lessened and as a whole, the productivity is improved.

(5) Since the exhaust gas is combusted in the combustion chamber to become high in temperature before harmless and it is sent to the preheating vessels, the preheating effect is improved and the danger of the operation is lessened.

(6) As a result of the preheating vessels leaning toward the center axis side of the melting furnace, the channeling of the exhaust gas is suppressed and the effect of preheating the raw material is heightened.

(7) By utilizing the gas lowered in temerature which prevails around a discharging side in the preheating vessel, a combustion amount of the gas burning in the combustion chamber is controlled. Therefore, trouble occuring due to excess heating of the apparatus can be decreased.

(8) Since the material is fed out alternately from the two preheating vessels, the material is continuously fed at a substantially constant feed rate in the melting furnace and stable operation is procured.

(9) Since the movable electrode is located outside of the combustion chamber, the length of the electrode can be minimized in the melting furnace and the consumption of the surface of the electrode by oxidation can be lessened.

(10) Since the movable electrode is inserted slantwise, arc can be stably generated relative to the raw material around the center portion of the melting furnace even if a special operation in which the melt is lessened is carried out.

Since as mentioned in the foregoing, the factors which cause the trouble during operation can be removed, it is possible to perform an operation of the melting furnace without man-power.

According to the present invention, the height of the shaft-shaped preheating vessel can be minimized to the extent necessary, the equipment and facilities can be simplified to be compact, the exhaust gas can be made usable for the preheating of the raw material by combusting the exhaust gas to be high in temperature and harmless, the preheated raw material is fed uniformly around the electrode, and the consumption of the electrode can be remarkably reduced.

What is claimed is:

1. A melting furnace comprising:

preheating vessels for preheating raw material to produce a preheated raw material;

a melting furnace body having tilting means for tilting the melting furnace body and heating means for heating the preheated raw material;

a furnace roof for covering an upper part of the melting furnace body;

a combustion chamber, arranged on the furnace roof, for burning a gas generated in the melting furnace body;

feed openings, arranged at side faces of the combustion chamber, for feeding the preheated raw material into the melting furnace body, said side faces of the combustion chamber being positioned at a right angle to a tilting direction of the melting furnace body;

supply openings, arranged at lower ends of the preheating vessels, for supplying the preheated raw material through the feed openings to the melting furnace body; and connecting means for movably connecting the supply openings with the feed openings when the melting furnace body is tilted by said tilting means.

2. The melting furnace of claim 1, wherein said feed openings and said supply openings have a common axis and the melting furnace body tilts around said common axis.

3. The melting furnace of claim 1, further comprising removal means for removing at least one of the preheating vessels in a direction perpendicular to the tilting direction of the melting furnace body.

4. The melting furnace of claim 1, wherein said heating means comprises a movable electrode and a bottom electrode, the bottom electrode being attached to a bottom portion of the melting furnace body, and the movable electrode being positioned above the melting furnace body outside the combustion chamber and being movable through the furnace roof.

5. The melting furnace of claim 1, wherein the preheating vessels are shaft shaped.

6. The melting furnace of claim 1, wherein the preheating vessels include feeding means, arranged at a lower end of each preheating vessel, for introducing the preheated raw material through the supply openings to the melting furnace body.

7. The melting furnace of claim 6, wherein said feeding means is a pusher.

8. The melting furnace of claim 6, wherein said feeding means is a vibrating feeder.

9. The melting furnace of claim 1, wherein said connecting means comprises a first flange arranged at an end portion of each of the feed openings, a second flange arranged at an end portion of each of the supply openings, and a pressing device for pressing each respective second flange on each respective first flange.

10. The melting furnace of claim 1, wherein said combustion chamber includes a nozzle for supplying oxygen gas to burn gases generated in the melting furnace body.

11. The melting furnace of claim 1, wherein said combustion chamber includes a blowing inlet for supplying thereinto an exhaust gas which is exhausted from the preheating vessels.

12. The melting furnace of claim 1, wherein said heating means comprises a movable electrode positioned above the melting furnace body outside the combustion chamber, said movable electrode being movable through the furnace roof.

* * * * *

UNITED STATES PATENT AND TRADEMARK OFFICE

CERTIFICATE OF CORRECTION

PATENT NO. : 5,535,235

DATED : July 9, 1996

INVENTOR(S) : Norio AO et al.

It is certified that error appears in the above-indentified patent and that said Letters Patent is hereby corrected as shown below:

Column 1, line 15, after "slag." insert --For example,--.

Column 2, line 17, after "Japanese" insert --Unexamined--.

Column 2, line 51, after "materials" delete "and to make it harmless to the environment";

Column 2, line 52, after "materials" insert --and to make it harmless to the environment--.

Column 3, line 42, after "positioned" insert --at--.

Column 3, line 44, after "at" delete "a".

Column 3, line 52, replace "burnt to be" with --converted to--.

Column 4, line 35, replace "separetion" with --separation--; same line, replace "troubling" with --problematic--.

Column 4, line 62, replace "preheting" with --preheating--.

UNITED STATES PATENT AND TRADEMARK OFFICE

CERTIFICATE OF CORRECTION

PATENT NO. : 5,535,235

DATED : July 9, 1996

INVENTOR(S) : Norio AO et al.

It is certified that error appears in the above-indentified patent and that said Letters Patent is hereby corrected as shown below:

Column 5, line 39, change "with" to --which--.

Column 5, line 44, replace "chamber 12" with --chamber 23--.

Column 5, line 48, replace "In stead" with --Instead--.

Column 5, line 51, replace "inlet 5" with --inlet 35--.

Column 7, line 10, replace "before harmless and" with --and harmless before--.

Column 7, line 18, replace "temerature" with --temperature--.

Column 8, line 36 (Claim 7, line 2), replace "is" with --comprises--.

Column 8, line 38 (Claim 8, line 2), replace "is" with --comprises--.

Signed and Sealed this

Seventh Day of January, 1997

Bruce Lehman

*Attest:*

BRUCE LEHMAN

*Attesting Officer*

*Commissioner of Patents and Trademarks*